US007926424B1

(12) United States Patent
Quintana et al.

(10) Patent No.: US 7,926,424 B1
(45) Date of Patent: Apr. 19, 2011

(54) LIQUID MIST TRACER FOR SHOTGUN AMMUNITION

(76) Inventors: Mauricio F. Quintana, The Woodlands, TX (US); James Alfred Dunnam, Austin, TX (US)

( * ) Notice: Subject to any disclaimer, the term of this patent is extended or adjusted under 35 U.S.C. 154(b) by 844 days.

(21) Appl. No.: 11/899,317

(22) Filed: Sep. 5, 2007

(51) Int. Cl.
*F42B 7/02* (2006.01)

(52) U.S. Cl. ..... 102/458; 102/455

(58) Field of Classification Search ..... 102/458, 102/448, 449, 459, 460, 513, 370, 455
See application file for complete search history.

(56) References Cited

U.S. PATENT DOCUMENTS 1,450,579 A * 4/1923 Chilowsky ..... 102/473
5,361,701 A * 11/1994 Stevens ..... 102/450
5,565,649 A * 10/1996 Tougeron et al. ..... 102/502
6,250,228 B1 6/2001 King
6,931,993 B1 * 8/2005 Manole et al. ..... 102/458
7,228,801 B2 6/2007 Dunnam et al.
7,317,662 B2 * 1/2008 Unsworth et al. ..... 367/144
2006/0278116 A1 * 12/2006 Hunt ..... 102/512

* cited by examiner

*Primary Examiner* — James S Bergin
*Assistant Examiner* — Daniel J Troy
(74) *Attorney, Agent, or Firm* — Mary J. Gaskin

(57) ABSTRACT

A tracer cylinder for use with a shotgun shell to provide an aiming and training aid for shotgun shooting sports, which also can be used for military and police applications. The tracer cylinder, which contains a liquid, has one or more openings, each one releasably closed with a valve. The tracer cylinder is loaded into a shotgun shell and fired. After the valve in the bottom of the cylinder is released, the liquid is extracted through the opening by physical forces, creating a long-lasting mist or fog cloud that is visible to the shooter. The shooter is provided with a consistent and durable reference, allowing him or her to make effective corrections to his or her shooting technique. The tracer cylinder can be loaded into a shot holder, with or without shot pellets.

15 Claims, 7 Drawing Sheets

LIQUID MIST TRACER FOR SHOTGUN AMMUNITION

FIELD OF INVENTION

This invention relates to shotgun ammunition, more specifically to tracers used to make the shot visible to shooters. This invention serves as a training aid to improve one's shooting ability for shotgun sports such as Trap, Skeet or Sporting Clays. It also serves as a shotgun aiming and training aid for hunters, with applications for military and police personnel.

BACKGROUND OF THE INVENTION

All shotgun sports require the shooter to accurately predict the trajectory of the target. Mastering the lead is the greatest challenge in shotgunning sports. The lead is defined as the distance in front of the moving target, which the shooter aims and shoots at in order to break the target. The particular lead will vary, depending on the application, shot type, shot speed, shooter's technique, speed and angle of the target, and atmospheric conditions; it can range from a few inches to more than ten feet.

The visibility of an object to the human eye generally depends on the size of the object, the relative distance between the object and the observer, the relative speed of the object, the color of the object, and the light intensity and atmospheric conditions. The human brain and eye refresh images approximately every 0.1 seconds, while the average shot flight time to the target ranges from approximately 0.05 to 0.3 seconds; this makes shooting moving objects a real challenge.

Inventors have developed tracers for shotgun shells in an attempt to aid the shooter in visualizing his or her shot with regard to the target. Prior inventions can be categorized as non-ignition and ignition type tracers. Each type has its limitations, including the risk of fire with pyrotechnic tracers and the complexity of manufacturing in the case of chemiluminescent tracers. Both types share a significant drawback: the fact that the shooter has a mere fraction of the second to see the tracer. This makes current inventions of limited value to shooters in providing a consistent and visible reference to aid them in correcting their shooting.

The prior art includes the following inventions:

1. Shot-Shell (U.S. Pat. No. 1,304,962 to J. Gravely in 1919);
2. Shotgun Shell (U.S. Pat. No. 1,457,337 to E. Barrows in 1923);
3. Method and Apparatus for Forming Letters and Symbols in the Air (U.S. Pat. No. 1,716,794 to J. Remey, 1929);
4. Shotgun Cartridge (U.S. Pat. No. 1,887,990 to H. Brownsdon in 1932);
5. Artificial Production of Fog (U.S. Pat. No. 1,895,765 to U. Muller in 1933);
6. Method for Creating Aerial Effects (U.S. Pat. No. 2,062,511 to J. Haddock in 1936);
7. Tracer Shotshell (U.S. Pat. No. 3,262,390 to R. Cowles in 1966);
8. Apparatus for Producing Smoke or Fog (U.S. Pat. No. 3,244,641 to D. Durr in 1966);
9. Method and Means for Producing and Controlling the Discharge of Fog (U.S. Pat. No. 3,379,373 to R. Roberts in 1968);
10. Nebulizer (U.S. Pat. No. 3,652,015 to G. Beall in 1972);
11. Shotgun Shell Tracer Wad (U.S. Pat. No. 4,553,481 to V. Ricci in 1984);
12. Method and Apparatus for Sky Typing (U.S. Pat. No. 4,561,201 to G. Sanborn in 1985);

13. Efficient Artificial Smoke Generator (U.S. Pat. No. 4,836,452 to J. Fox in 1989);
14. Aerosol Diffusion Fogger (U.S. Pat. No. 5,057,243 to M. Becker in 1991);
15. Diffusion Fogger (U.S. Pat. No. 4,990,290 to J. Gill in 1991);
16. Tracer Cartridges (U.S. Pat. No. 5,429,054 to R. Topping in 1995);
17. Smoke Generator for Radio Controlled Aircraft (U.S. Pat. No. 5,932,978, to J. Geyer in 1999);
18. Compression Cartridge (U.S. Pat. No. 6,250,228 to F. King in 2003);
19. Shotgun Shell Flight Path Indicator (U.S. Pat. No. 6,539,873 to E. W. Diller in 2003);
20. Ballistic Tracer Platform for Shotgun Ammunition (U.S. Pat. No. 10,656,471 to J. Dunnam and M. Quintana in 2007).

An improved design would overcome the drawbacks of the prior art and would fulfill the following criteria:

(a) Provide the shooter with a consistent and accurate reference to the target.
(b) Give the shooter more time to see the tracer with reference to the target; in other words the improved design should have memory.
(c) Be safe to use and environmentally friendly.
(d) Be simple and economical to manufacture.
(e) Be entertaining to the shooter.

SUMMARY OF INVENTION

The present invention provides an innovative design for a tracer that comprises a tracer cylinder that contains a liquid, which utilizes appropriate valves, and which, when loaded into a shotgun shell and fired, has the means to release the liquid and emit a thick and long-lasting mist or fog cloud that provides the shooter with a consistent and durable reference, allowing him or her to make effective corrections to his or her shooting technique. The invention uses any one of a variety of liquid compounds, such as vegetable oil, mineral oil, synthetic oil, paints, water, aqueous gels, and known fogging liquids such as titanium tetrachloride ($TiCl_4$). When water or an aqueous gel is used, various dyes, pigments, and/or reflective particles are added in order to make the fog cloud more visible to the shooter. This invention can be modified and can be used with all shot types and in many shotgun gauges, including 8, 10, 12, 16, 20, 28 and 410.

In accordance with the present invention, the tracer comprises a cylinder with a length equal to or larger than its diameter, thereby ensuring its accuracy. Holding the liquid of choice, the cylinder is loaded into a typical shotgun shell, strategically located in front of the shot pellets in order to minimize the structural stresses on the cylinder resulting from ignition of the propellant. The cylinder is typically separated and protected from the shot by a disc-type spacer. Alternatively, it can be loaded into the shot holder of a wad, with no shot pellets. In either case, the shot cup petals protect it during firing and acceleration of the wad and cylinder down the barrel. The cylinder can be sized to have different internal and exterior diameters and length combinations in order to adjust the volume of liquid, depending on the shotgun gauge with which it is used and other variables, such as the distance to the target and the size and type of shot.

The tracer cylinder has a disk-shaped top cap and a bottom portion defining a cavity; the two parts are glued or welded together before the liquid is injected into the cavity. The cylinder has at least two small openings that are strategically located, one in the center of the top cap and another in the bottom side of the cylinder, also in the center. The openings allow the liquid to be extracted from the cylinder due to the difference in pressure between the liquid inside the cylinder and the low pressure air surrounding the sides and bottom portion of the cylinder created as the cylinder moves rapidly through the air. Upon exiting the cylinder through the bottom opening, the miniature droplets of liquid create a mist or fog cloud, which is contained by the cone of air created at the rear of the cylinder, thereby increasing its density and making it visible for several seconds. This lasting fog cloud is visible to the eye in much the same way as a contrail or the tail of a comet, and it is easily seen by the shooter.

Each of the openings in the cylinder is fitted with a valve in order to prevent the liquid from exiting the cylinder before ignition of the shotgun shell. Upon firing, each valve is displaced, either by inertial forces present during the cylinder's acceleration in the barrel or by drag forces once the cylinder is airborne, without affecting the accurate movement of the cylinder in front of the shot.

Alternatively, the cylinder can also be fitted with symmetrically-positioned openings on its sidewall, each one using a drag-type valve. The addition of such openings allow the manufacturer to adjust the amount of liquid being expelled from the cylinder, affecting the diameter, density and duration of the fog cloud created.

It is an object of the present invention to provide a tracer comprising a cylinder that contains a liquid which, after exiting the barrel of a shotgun, produces a mist or fog cloud that accurately traces the shot and is easily visible to the shooter for a sufficient amount of time so that it can be effectively used to help him or her with his or her shooting technique.

Another object of this invention is to provide the means by which the liquid contained in the cylinder can be released without negatively affecting the accuracy of the tracer.

Still another object of this invention is to provide a tracer comprising a cylinder filled with liquid which, after exiting the barrel, produces a fog cloud similar to that of a comet trail or contrail, the invention providing the means to adjust the diameter and length of the cylinder, as well as the density and duration of the tracing effect, depending on the gauge of the shotgun shell and the application with which it is to be used.

A further object of this invention is to provide a tracer for shotgun ammunition, the device being accurate and safe to use in single barrel, double barrel and semi-automatic shotguns, and, further, being structurally sound and able to withstand the high stresses associated with its application.

Further objects and advantages of this invention will become apparent from a consideration of the drawings and description, infra.

DESCRIPTION OF THE PREFERRED EMBODIMENTS

Figure 1:
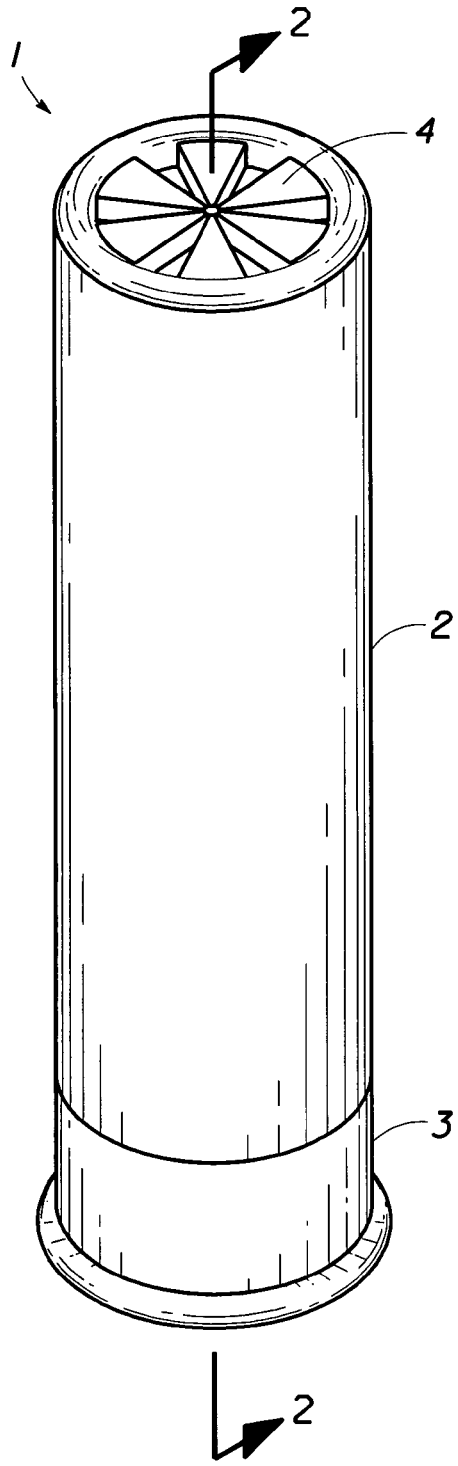
FIG. 1 is an isometric view of a shotgun shell containing the tracer cylinder of the present invention.

The present invention is designed to be used in a typical shotgun shell 1, which generally has a hull 2 with a metal base cap 3 and a crimped top 4, as shown in FIG. 1.

Figure 2:
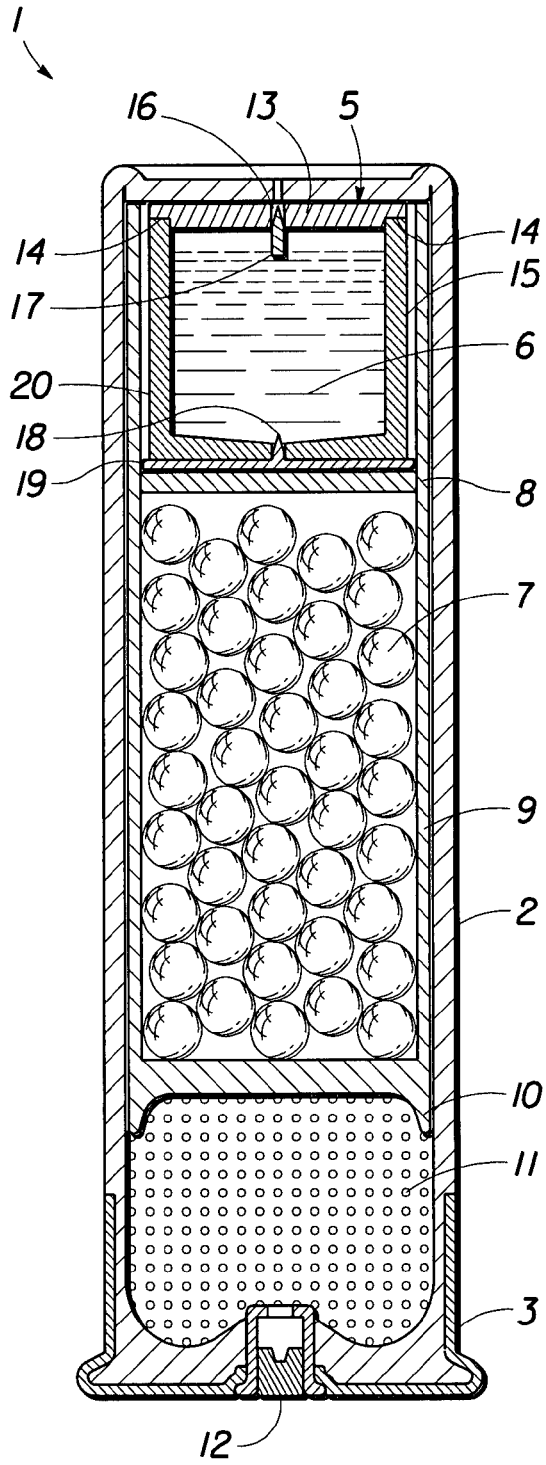
FIG. 2 is a sectional side view of the shell of FIG. 1, taken along line 2-2, showing the tracer cylinder strategically positioned in the shotgun shell, in front of the shot.

The sectional view in FIG. 2 shows the shotgun shell 1 with hull 2 and base cap 3, which has been assembled to hold the tracer cylinder 5 containing the tracer liquid 6, which is positioned in front of or on top of the shot pellets 7, separated therefrom and protected by a disk-shaped spacer 8, made of plastic, felt, cardboard, cork, or a similar commonly-used material. The shot pellets 7 are enclosed in a shot cup 9, which incorporates a gas seal 10 that is in direct contact with the propellant 11, which is next to the primer 12 at the lower end of the shotgun shell 1. The cylinder 5 consists of a top cap 13 with a radial indentation 14 and a container 15. The radial indentation 14, or step, provides more contact surface for glueing or welding the cap 13 to the container 15. It also permits easier and more accurate alignment of the two parts. The cap 13 has an opening 16 that has been sealed with a press-fit inertial valve 17. The bottom of the container 15 has an opening 18 that has been sealed with a drag-type, disk-shaped valve 19. Together the valves 17, 19 keep the tracer liquid 6 from spilling out of the tracer cylinder 5 prior to use. The tracer liquid 6 used can be any one of a variety of liquid compounds, such as vegetable oil, mineral oil, synthetic oil, paint, water, and aqueous gels, as well as known fogging liquids such as titanium tetrachloride ($TiCl_4$). When water or an aqueous gel is used, various dyes, pigments, and/or reflective particles are added in order to make the fog cloud more visible to the shooter. The space between the cylindrical sidewall 20 of the container 15 and the shot cup 9 is typically filled, either by using a shot cup 9 with petals having thickened upper portions, or by inserting a resilient spacer.

Figure 3:
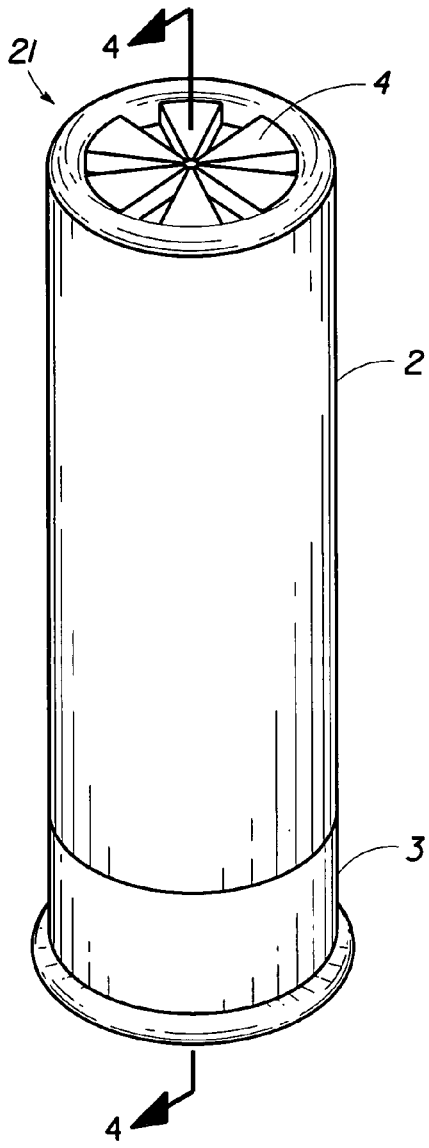
FIG. 3 is an isometric view of an alternative shotgun shell containing the tracer cylinder of the present invention.

Shown in FIG. 3 is an alternative shotgun shell 21, which generally has a hull 2 with a metal base cap 3 and a crimped top 4.

Figure 4:
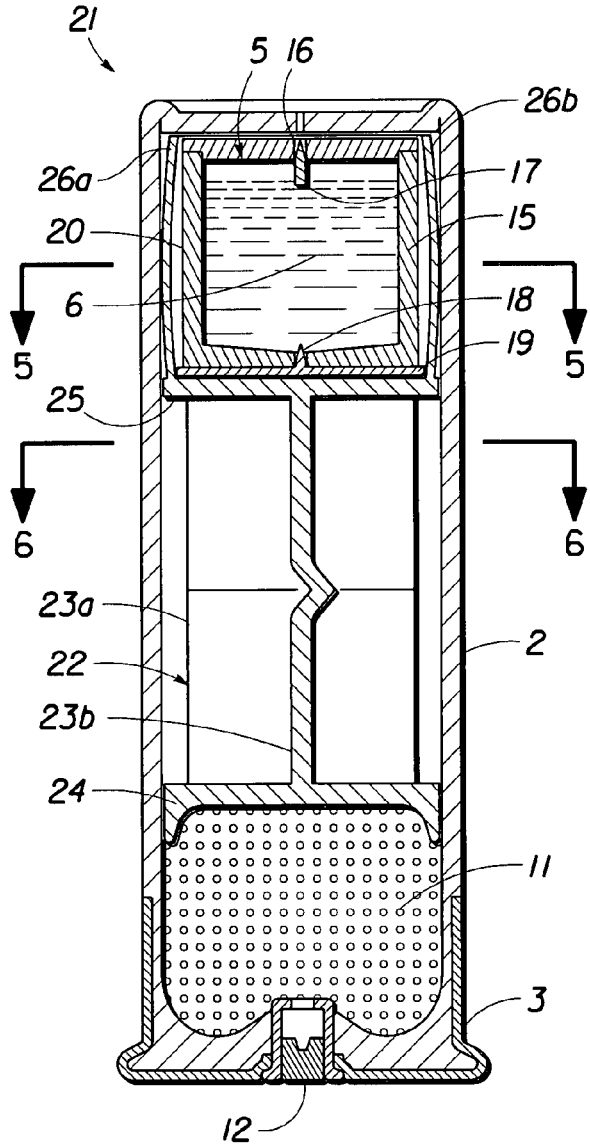
FIG. 4 is a sectional side view of the alternative shotgun shell containing the tracer cylinder illustrated in FIG. 3 taken along line 4-4.

As shown in FIG. 4, when used with the alternative shotgun shell 21, the tracer cylinder 5, with container 15 holding tracer liquid 6, can be loaded into a conventional wad without any shot pellets, particularly when a shooter wishes to fire it merely as an indicator or reference. When this embodiment is assembled, a cylindrical wad 22, made from polypropylene, polyethylene, or another high-strength plastic, is placed inside the hull 2 of the shell 21 above the propellant 11 inside base cap 2. The wad 22 is typically formed with shock-absorbing compression columns 23*a*, 23*b*, (23*c*, 23*d*) and has a gas seal 24 formed in its lower end. The tracer cylinder 5 is then placed into the wad shot holder 25, inside the petals 26*a*, 26*b*, (26*c*, 26*d*), which surround the sidewall 20 and cushion the tracer cylinder 5 during ignition, and which open and fall away when the tracer cylinder 5 is in flight. Like the tracer cylinder 5 in FIG. 2, the container 15 has an upper opening 16 that has been sealed with a press-fit inertial valve 17, and a lower opening 18 that has been sealed with a drag-type, disk-shaped valve 19.

Figure 5:
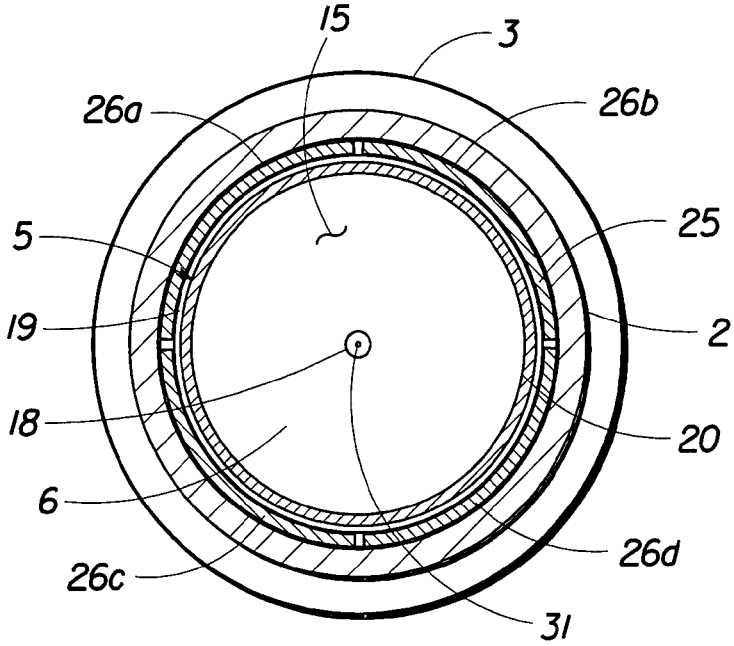
FIG. 5 is an enlarged cross-sectional view of the top of the alternative shotgun shell containing the tracer cylinder illustrated in FIG. 4 taken along line 5-5.

FIG. 5 shows the sidewall 20 of the container 15 inside the petals 26*a*, 26*b*, 26*c*, 26*d* of the shot holder 25 inside the hull 2. The opening 18 has been sealed with a protrusion 31 on the top of disk-shaped valve 19, and the container 15 has been filled with tracer liquid 6.

Figure 6:
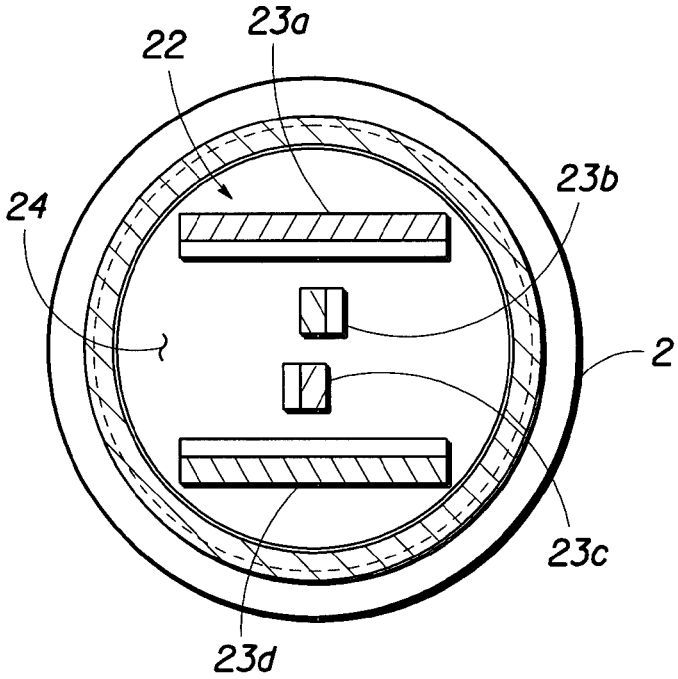
FIG. 6 is an enlarged cross-sectional view of wad inside of the alternative shotgun shell containing the tracer cylinder illustrated in FIG. 4 taken along line 6-6.

FIG. 6 shows the shock-absorbing compression columns 23*a*, 23*b*, 23*c*, 23*d* of the wad 22 inside the hull 2, as well as the gas seal 24.

Figure 7:
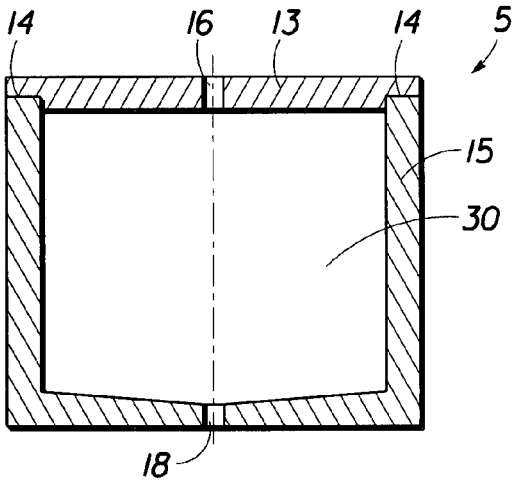
FIG. 7 is a sectional side view of an empty tracer cylinder, without valves.

FIG. 7 shows an empty tracer cylinder 5, consisting of a disk-shaped top cap 13 with radial indentation 14 and a cylindrical container 15, which are glued or welded together, creating a cavity 30. Both parts of the cylinder 5 are typically made from a high-strength plastic, such as polypropylene or polyethylene, or from nylon, using standard high volume processes, including injection molding and high-speed screw machines. Alternatively, the top cap 13 and container 15 can be made from a metal, such as brass, aluminum, copper or steel, using stamping and deep drawing techniques. Optimally, the top cap 13 can be formed to have a small, centrally-located opening 16; the container 15 has a small, centrally-located opening 18 in its bottom side. The size of each opening can range from approximately 0.5% to 5% of the diameter of the cylinder 5, depending on the number of openings used, the speed at which the cylinder will travel, and the type and viscosity of the liquid used as a tracer. The openings need to be small enough to extract minute droplets of liquid in order to create a mist or fog cloud upon exiting the cylinder, yet large enough to allow the liquid to flow out of the cylinder due to the difference in pressure exerted on the liquid inside the cylinder and the low pressure air surrounding the sides and bottom portion of the cylinder. The top cap 13 and the container 15 are joined together before the tracer liquid 6 is injected into the cavity 30. The joining process can be performed in a number of ways, such as using a combination of specialized high strength glues and accelerators, soldering, or welding, including ultrasonic welding.

Figure 8:
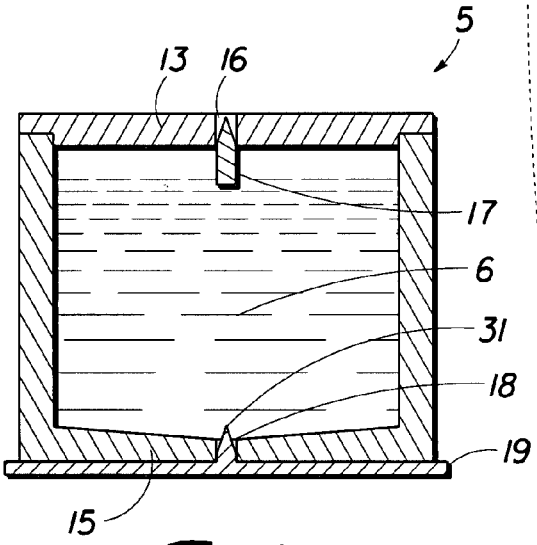
FIG. 8 is a sectional side view of a tracer cylinder containing liquid, with a cone-shaped valve pressed against the small opening in the top cap and a disk-shaped valve with an interference fit into the opening on the bottom portion of the cylinder in order to keep the liquid inside the cylinder.

FIG. 8 is a sectional view of the cylinder 5 shown in FIG. 7, which has been filled with tracer liquid 6 and is shown with two openings, each sealed with a valve in order to keep the tracer liquid 6 from leaking from the cylinder 5 before ignition. The first is a cone-shaped inertial valve 17 pressed into the small opening 16 in the top cap 13, and the second is a drag-type, disk-shaped valve 19 with a centrally-located protrusion 31 that interference-fits into the opening 18 in the bottom of the container 15. The tracer cylinder 5 can perform effectively with only the opening 18 releasably sealed with the disk-shaped valve 19. In any event, the number of valves used will depend on the number and location of the openings.

The inertial cone-shaped valve 17, which can be made from metal or plastic, must be press-fit into the opening 16 from the lower side of the top cap 13 and before the top cap 13 and container 15 of the cylinder 5 are glued or welded together. The cylinder 5 is then flipped over, and the tracer liquid 6 is injected into the cavity 30 through opening 18. The tracer liquid 6 is loaded into the cylinder 5 at atmospheric pressure or at a slightly higher pressure to aid in the flow of the tracer liquid 6 out of the tracer cylinder 5, depending on the type of shell 1 used and the distance to the target. Opening 18 is then releasably sealed, using a disk-shaped valve 19, which generally has a diameter that is slightly larger than the diameter of the cylinder 5 so that its edges extend past the sidewall 20 of the container 15. The disk-shaped valve 19 can be made from plastic, rubber, or metal, using standard injection molding and stamping processes. The disk-shaped valve 19 has a cone-shaped protrusion 31 in its center that is interference-fitted into the opening 18 in the bottom of the container 15.

Figure 9:
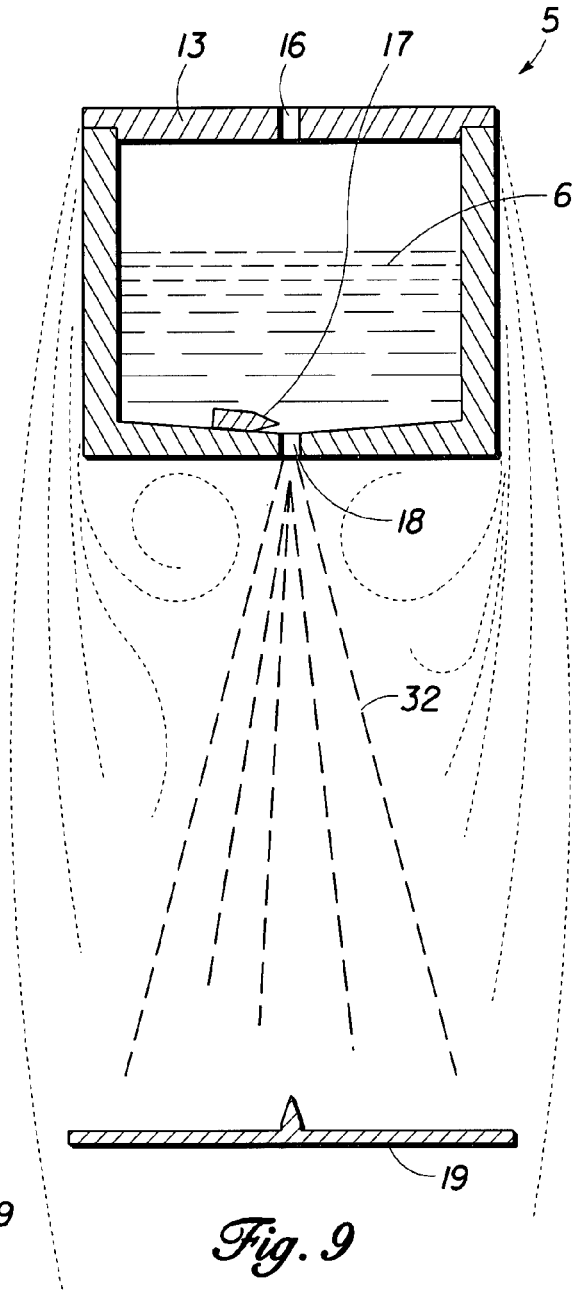
FIG. 9 shows a sectional side view of an airborne tracer cylinder after the shell has been fired from a shotgun, the cone-shaped valve having been displaced as a result of inertial forces, and the disk-shaped valve having fallen away due to air drag forces, the liquid being released into the atmosphere by the vacuum created in the air surrounding the tracer cylinder.

FIG. 9 shows a sectional view of the tracer cylinder 5 of FIG. 8 once it is airborne and after the shotgun shell (1 or 21) has been fired. The cone-shaped inertial valve 17 is shown resting on the bottom of the container 15, having been displaced from the opening 16 in the top cap 13 by inertial forces during acceleration. The disk-shaped valve 19 has been detached due to air drag forces exerted on its edges after the tracer cylinder 5 is airborne. Because of the symmetrical arrangement of the valves, their removal occurs without affecting the accuracy of the cylinder 5. In accordance with the physical law of conservation of energy and mass, after the valves 17, 19 are removed, the tracer liquid 6 in the tracer cylinder 5 is drawn out through the bottom opening 18 due to the low-pressure area surrounding the cylinder 5 upon flight.

The small opening 16 in the top cap 13, while not necessary for the expulsion of the tracer liquid 6, helps to avoid the collapse of the cylinder's 5 structure which may otherwise result from the vacuum created when the tracer liquid 6 leaves the cylinder 5 thereby assuring the reliability and effectiveness of the device. Further, the opening 16 helps balance the pressure within the cylinder 5, thereby facilitating the extraction of the tracer liquid 6. When the cylinder 5 is constructed with opening 16, the inertial valve 17 is displaced when the shell 1 is ignited, after which it falls through the tracer liquid 6, which slows its movement, before it settles on the bottom of the container 15, without blocking the bottom opening 18. Once the cylinder 5 is airborne, air drag forces on the edges of the disk-shaped valve 19 cause it to become detached from the bottom of the container 15, allowing the tracer liquid 6 to be drawn from the cylinder 5 into the atmosphere. Because the disk-shaped valve 19 is symmetrically positioned on the bottom side of the container 15, it separates without affecting the accuracy of the device. The tracer liquid 6 exits through the small opening 18 in the form of small droplets 32, which create a fog mist or cloud that is highly visible to the shooter (i.e., the sunlight reflects off the increased surface area of the droplets). Because only small droplets 32 are released from the cylinder 5, the amount of tracer liquid 6 the cylinder 5 must hold can be very small and, therefore, the device is extremely efficient. Because the tracer liquid 6 exits the cylinder 5 through the bottom opening, the fog cloud created is contained within the cone of air created by the air stream at the back of the cylinder 5, thereby increasing its density and making it visible for several seconds. This long-lasting fog cloud mimics the tail of a comet and is easily seen by the shooter.

Figure 10:
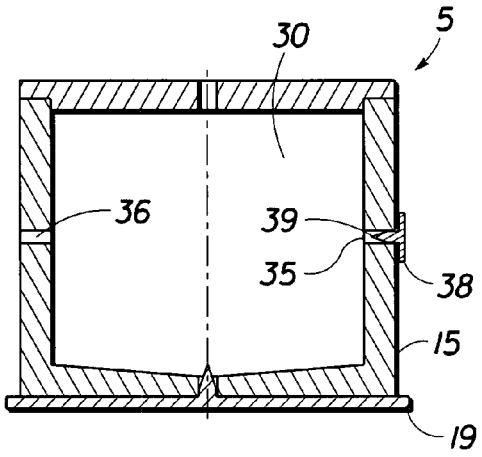
FIG. 10 is a sectional side view showing optional lateral openings, one with a valve, in the sidewall of the tracer cylinder.

FIG. 10 is a sectional view of an alternate embodiment of the cylinder 5, showing symmetrically-positioned lateral openings 35, 36 in the sidewall 20 of container 15, which can be used to increase the flow and visual effects of the tracer liquid 6 when it enters the atmosphere. Each opening 35, 36 is or will be sealed with a drag-type sidewall valve 38, which has been press-fit into place. Each sidewall valve 38 can be made from plastic, rubber or metal, and is formed with disc-shaped or rectangular parts that are slightly curved to match the outer surface of the container 15. Each sidewall valve 38 has a centrally-positioned, cone-shaped protrusion 39, which is inserted into an opening 35, 36 in order to seal it. Once the cylinder 5 is airborne, air drag forces on the cylinder 5 remove sidewall valve 38 and allow the tracer liquid 6 to be extracted from the cavity 30. Again, because of the symmetrical positions of the openings and valves, the accuracy of the device is not negatively affected when the sidewall valve 38 and the disk-shaped valve 19 are released. The addition of lateral openings 35, 36 can be used to increase the diameter, density and duration of the fog cloud created. For instance, the amount of tracer liquid 6 being expelled can be adjusted in order to produce a fog cloud that mimics the shot pattern. This embodiment is particularly effective when the target is engaged at short distances. Because the tracer liquid 6 is extracted from the cylinder 5 more rapidly, the fog cloud created has a larger diameter, thereby helping the shooter better visualize his or her shot.

Figure 11:
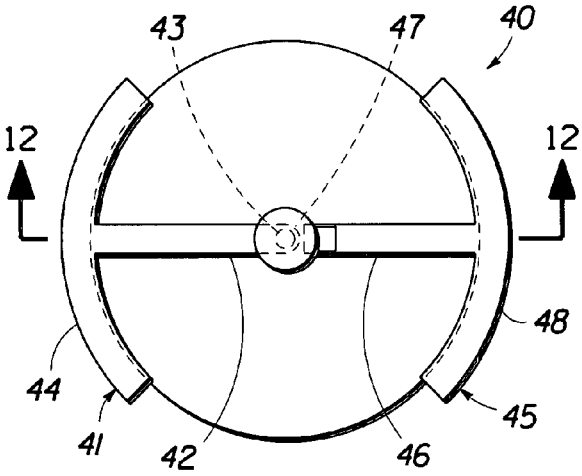
FIG. 11 is a top view of an alternate two-part valve that can be used to seal the opening in the cap of the tracer cylinder.

FIG. 11 is a top view of another type of valve that can be used to seal the opening in the top cap 13. The two-part valve 40 consists of two complementary sections: a first section 41 and a second section 45. The first section 41 has a bar 42 having an opening 43 formed in one end and an annular portion 44 attached to the other end. The second section 45 has a bar 46 having a protrusion 47 on the first end and an annular portion 48 attached to the other end. Both sections 41, 45 can be made from plastic or metal, using standard manufacturing processes, such as metal stamping or injection-molding. The first section 41 and the second section 45 are aligned and the protrusion 47 of the second section 45 is inserted through the opening 43 of the first section 41, then into the opening 16 in the top cap 13. When the valve 40 is installed, the annular portions 44, 48 extend past the outer circumference of the top cap 13.

Figure 12:
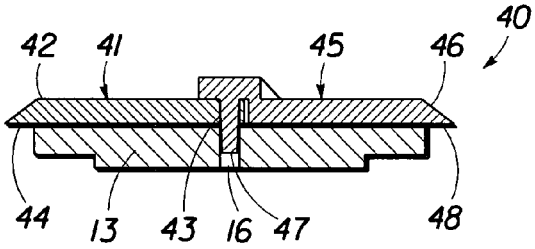
FIG. 12 is a sectional view of the alternate two-part valve shown in FIG. 11, taken along line 12-12.

FIG. 12 is a sectional view of the two-part valve 40 of FIG. 11 showing how the first section 41 and the second section 45 interlock and close the opening 16 in the top cap 13. The protrusion 47 of the second section 45 has been inserted through the opening 43 of the first section 41, then press-fit into opening 16 of the top cap 13. Annular portions 44, 48 extend past the outer circumference of the top cap 13. It is important to note that, in order for valve 40 to work properly, the total projected area of the annular sections 44, 48 needs to be larger than the total projected area of the bars 42, 46.

Figure 13:
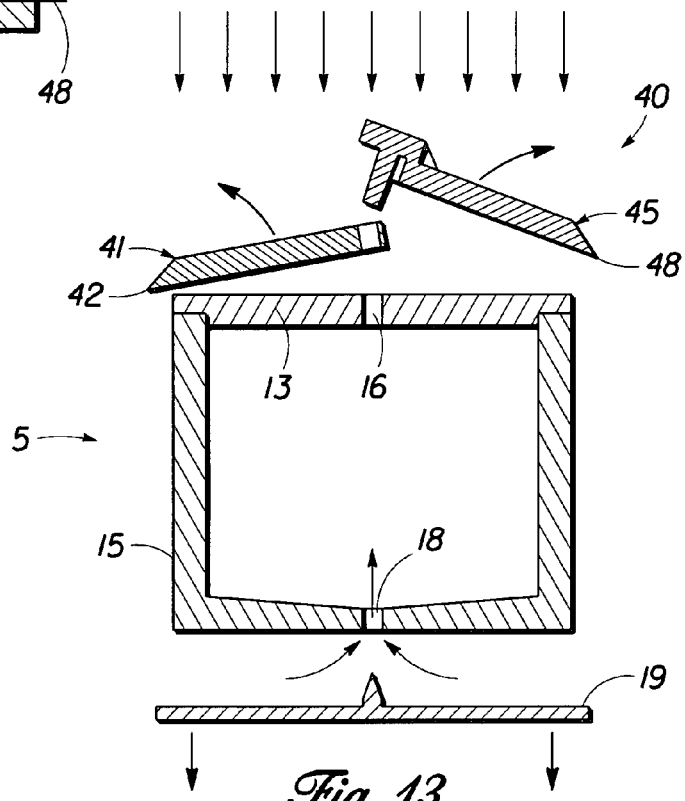
FIG. 13 is a sectional view of the cylinder shown in FIG. 11, showing the alternate valve after the cylinder leaves the barrel and how it is displaced by air drag forces.

FIG. 13 is a sectional view of the tracer cylinder 5 shown in FIG. 10, which has the disk-shaped valve 19 shown in FIG. 8 and the two-part valve 40 shown in FIG. 11. Both of the valves 19, 40 have been detached after the cylinder 5 is airborne. Air drag forces on the edges of the disk-shaped valve 19 cause it to separate from the tracer cylinder 5 and unplug the opening 18 in the bottom of container 15. The same forces exerted on the annular portions 44, 48 of the two-part valve 40 impart a movement, causing the first section 41 and the second section 45 to rotate in opposite directions, one clockwise and the other counter-clockwise, causing them to separate and fall away from the top cap 13, exposing the opening 16 to the air.

In still another embodiment, the cylinder can be enclosed in an annular cylinder made of plastic, cardboard or paper, to accommodate the use and production of a standardized tracer device that can be used in different shotgun gauges.

FIGS. 14A-14D show the typical movement of the tracer cylinder 5 before and after ignition of the shotgun shell 1.

Figure 14A:
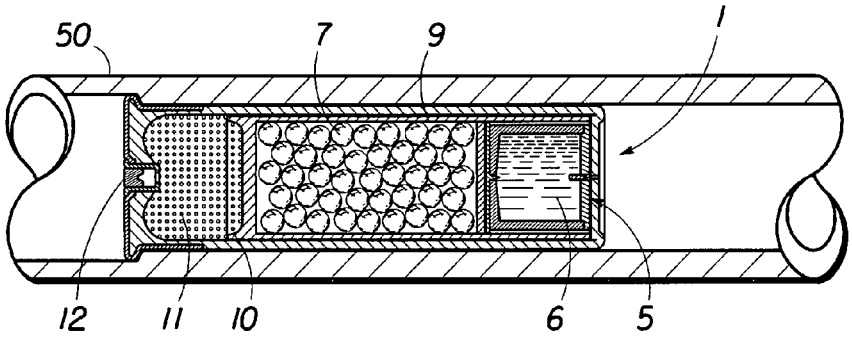
FIGS. 14A through 14D are sequential sectional side views of the tracer cylinder before and after ignition of the shell, showing the displacement of the valves and the release of the liquid from the tracer cylinder.

In FIG. 14A, the shotgun shell 1, containing a shot cup 9 with shot pellets 7, has been loaded into the shotgun barrel 50, along with the cylinder 5 holding tracer liquid 6. The primer 12 ignites the propellant 11, and gasses expand into the gas seal cavity 10.

Figure 14B:
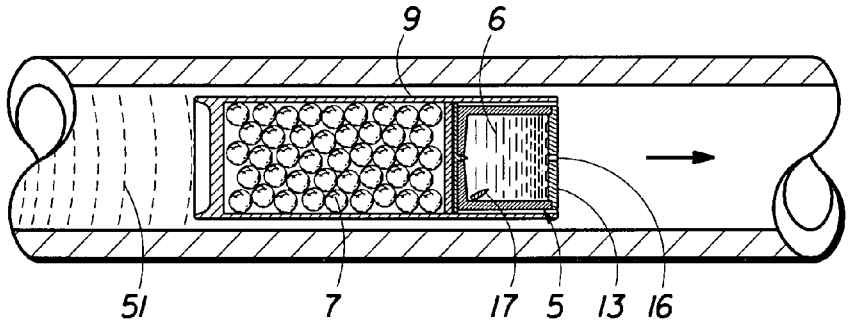

In FIG. 14B, the expanding gases 51 of ignition propel the shot cup 9 with shot pellets 7 and the cylinder 5 holding the tracer liquid 6 through the shotgun barrel 50. The forces of ignition have displaced the inertial valve 17 from the opening 16 in the top cap 13.

Figure 14C:
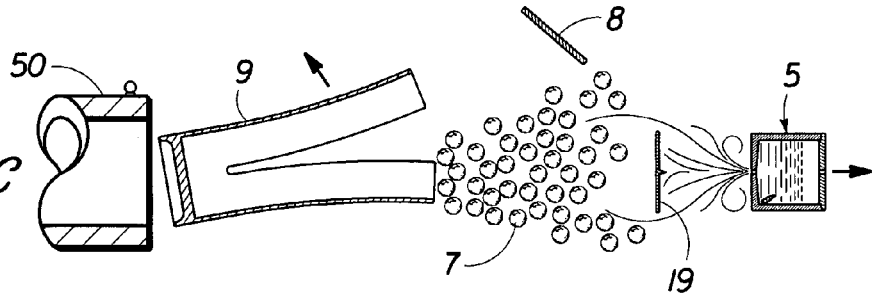

In FIG. 14C, after leaving the shotgun barrel 50, the shot cup 9 has flipped out of the way of the scattering shot pellets 7. The spacer 8 has also flipped out of the way, the disk-shaped valve 19 has been detached, and the cylinder 5 continues to travel in front of the pattern of shot pellets 7.

Figure 14D:
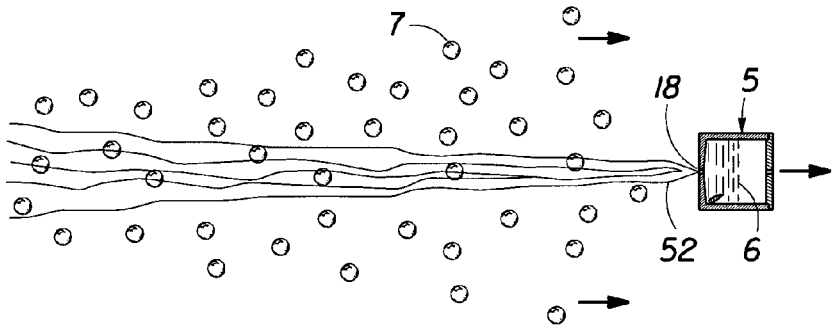

As shown in FIG. 14D, the tracer liquid 6 is being drawn from the opening 18 in the bottom of the cylinder 5, creating a fog cloud 52, which coincides with the pattern of shot pellets 7.

Figure 15:
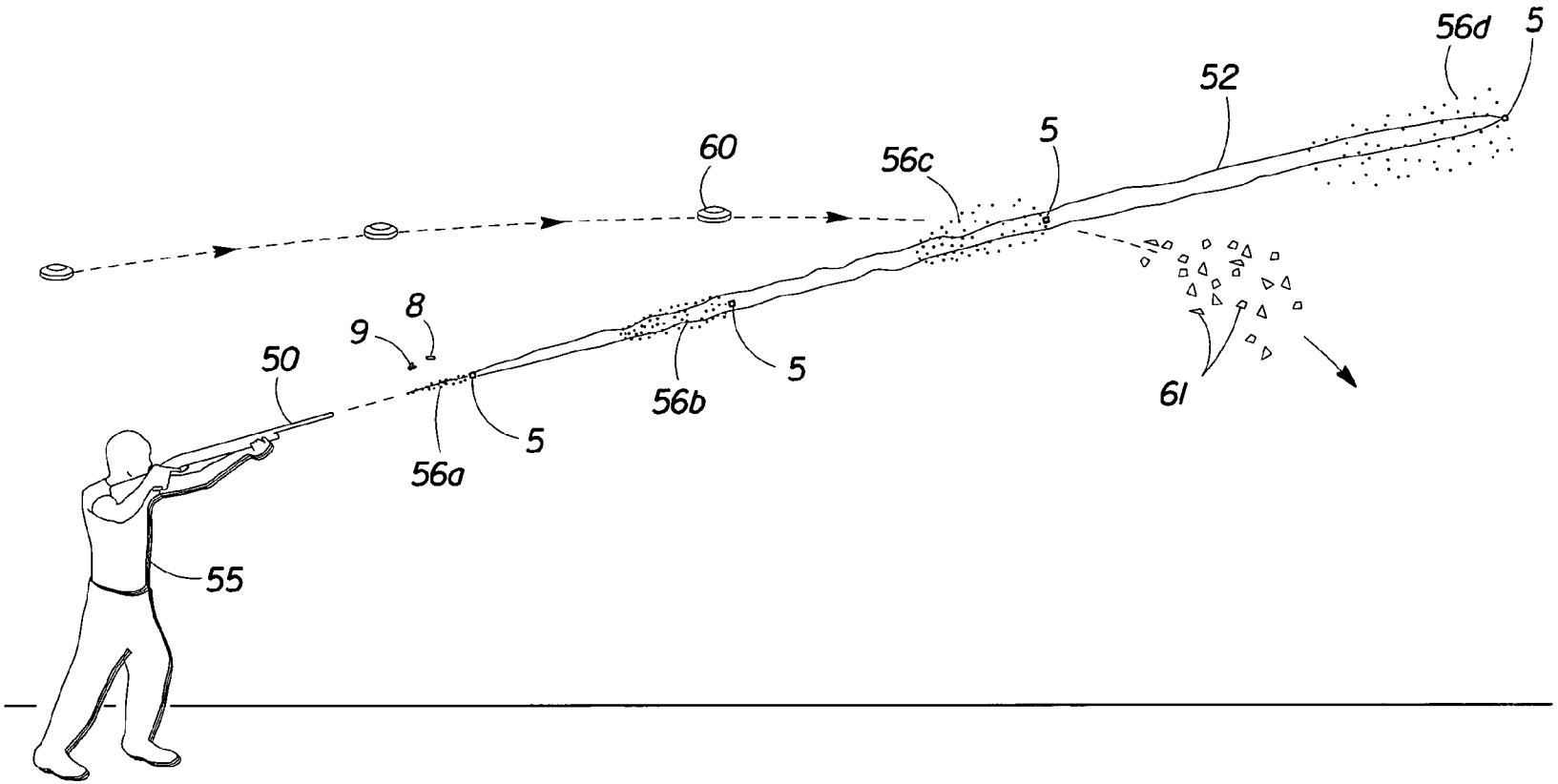
FIG. 15 is a representational view of a shooter using the tracer cylinder of the present invention while shooting at a clay target.

FIG. 15 shows a shooter 55 using the tracer cylinder 5 of the present invention. The shooter 55 has loaded his shotgun barrel 50 with the shotgun shell (1 or 21), as he would load any other ammunition. The shooter 55 has aimed at the clay target 60 and has fired. The cylinder 5 has left the shotgun barrel 50, in front of the shot string 56*a*, 56*b*, 56*c*, 56*d*, leaving a fog cloud 52 streaming through the center of the expanding pattern of shot pellets in the shot string 56. The shot cup 9 and spacer 8 have flipped out of the way. If the shooter 55 hits the clay target 60, it breaks into pieces 61. If he misses the clay target 60, the shooter 55 would correct his lead or aiming point, according to the relative position of the fog cloud to the clay target 60.

The information in the disclosure and description of the invention itself are illustrative only of the application of the principles of the present invention. Modifications and alternative embodiments may be devised by those skilled in the art without departing from the spirit and scope of the present invention.

We claim:

1. A tracer cylinder for use with a shotgun shell having a lower end and an upper end, and further having propellant and a shot cup, the propellant being contained inside the lower end of the shotgun shell, the tracer cylinder comprising a container having a bottom with a small central opening, the opening closed by a removable valve, the container holding a liquid material capable of creating a mist or fog cloud when released into the atmosphere as the liquid is extracted from the container through the opening in the bottom of the cylinder after the valve has been removed by a combination of physical forces resulting from ignition of the shell and movement of the cylinder through the air, the tracer cylinder designed for placement inside the upper end of the shot cup.

2. The tracer cylinder of claim 1 wherein the container is made from a material selected from the group consisting of polypropylene, polyethylene, nylon, brass, aluminum, copper and steel.

3. The tracer cylinder of claim 1 wherein the liquid material is selected from the group consisting of vegetable oil, mineral oil, synthetic oil, paint, and titanium tetrachloride ($TiCl_4$).

4. The tracer cylinder of claim 1 wherein the liquid material is selected from the group consisting of water and an aqueous gel, and an additive selected from the group consisting of dyes, pigments, and reflective particles is added to the liquid material.

5. The tracer cylinder of claim 1 wherein the container further comprises a top cap and a cylindrical sidewall.

6. The tracer cylinder of claim 5 wherein the sidewall has a certain circumference and the removable valve is a flat disk having a slightly larger circumference than the circumference of the sidewall, the flat disk further having a centrally-located protrusion capable of fitting into the central opening in the bottom side of the container.

7. The tracer cylinder of claim 5 wherein the top cap has a small central opening, the opening being closed with a second removable valve.

8. The tracer cylinder of claim 7 wherein the second removable valve is a cone-shaped valve having a point for pressing into the central opening in the top cap.

9. The tracer cylinder of claim 8 wherein the top cap has an outer circumference and the second removable valve has two complementary sections, the sections being interlocked and then press-fit into the central opening of the top cap, the sections having annular portions having edges extending past the outer circumference of the top cap.

10. The tracer cylinder of claim 5 wherein the sidewall has as least two small, symmetrically-arranged openings, each of the openings being closed with an additional removable valve.

11. The tracer cylinder of claim 10 wherein each of the additional removable valves is a drag-type valve for press-fitting into one of the openings in the sidewall.

12. The tracer cylinder of claim 1 wherein the cylinder has a height and a diameter, and the height of the cylinder is equal to or greater than the diameter of the cylinder.

13. The tracer cylinder of claim 12 wherein the small opening has a diameter ranging from 0.5% to 5% of the diameter of the cylinder.

14. A shotgun shell with a liquid mist tracer for making shot pellets' trajectory visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a shot cup partially filled with shot pellets;

(e) a disk-shaped spacer positioned above the shot pellets held in the shot cup;

(f) a tracer cylinder positioned inside the upper end of the shot cup proximate to the spacer, the tracer cylinder comprising a container having a bottom with a small central opening, the opening closed by a removable valve, the container holding a liquid material capable of creating a mist or fog cloud when released into the atmosphere as the liquid is extracted from the container through the opening in the bottom of the cylinder after the valve has been removed by a combination of inertial forces and drag forces.

15. A shotgun shell holding no shot, the shotgun shell having a liquid mist tracer for making the tracer's trajectory visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a cylindrical wad positioned proximate to the propellant, the wad having a shot holder; and (e) a tracer cylinder positioned in the shot holder inside the upper end of the shotgun shell, the tracer cylinder comprising a container having a bottom with a small central opening, the opening closed by a removable valve, the container holding a liquid material capable of creating a mist or fog cloud when released into the atmosphere as the liquid is extracted from the container through the opening in the bottom of the cylinder after the valve has been removed by a combination of inertial forces and drag forces.

* * * * *